US007661215B2

(12) United States Patent
Okamoto

(10) Patent No.: US 7,661,215 B2
(45) Date of Patent: Feb. 16, 2010

(54) MOUNTING STRUCTURE FOR MARKING PLATE

(75) Inventor: Makoto Okamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 621 days.

(21) Appl. No.: 11/559,070

(22) Filed: Nov. 13, 2006

(65) Prior Publication Data

US 2007/0131838 A1 Jun. 14, 2007

(30) Foreign Application Priority Data

Dec. 13, 2005 (JP) ..... 2005-358595

(51) Int. Cl.
*G09F 7/00* (2006.01)

(52) U.S. Cl. ..... 40/620; 40/663; 403/348

(58) Field of Classification Search ..... 40/622, 40/661.04, 661.11, 663, 620, 596, 607.13, 40/607.15, 668; 411/349, 549, 553; 248/71
See application file for complete search history.

(56) References Cited

U.S. PATENT DOCUMENTS 2,260,048 A * 10/1941 Newell ..... 411/552
2,355,196 A * 8/1944 Zahodiakin ..... 411/349
3,009,381 A * 11/1961 Rapata ..... 411/337
4,657,462 A * 4/1987 Hoen ..... 411/552
5,368,427 A * 11/1994 Pfaffinger ..... 411/553
5,526,598 A * 6/1996 Watanabe ..... 40/308
5,632,586 A * 5/1997 Nyholm ..... 411/552
6,679,646 B2 * 1/2004 Quardt et al. ..... 403/348
7,147,399 B2 * 12/2006 Viscount et al. ..... 403/349
2004/0190987 A1 * 9/2004 Yang ..... 403/348

FOREIGN PATENT DOCUMENTS

JP 2002-271053 9/2002

* cited by examiner

*Primary Examiner*—Lesley Morris
*Assistant Examiner*—Kristina Staley
(74) *Attorney, Agent, or Firm*—Oblon, Spivak, McClelland, Maier & Neustadt, L.L.P.

(57) ABSTRACT

A structure for mounting a marking plate is disclosed hereinafter as follows. A stem of a marking plate is inserted through a plate, and a spring member is provided at the tip end of the stem. Elastic portions of the spring member are elastically deformed so that a projection of each elastic portion is in elastic contact with the back surface of the plate. Accordingly, the engagement of the engaging portions of the marking plate side and the plate side and the engagement of the lock pawls and the engaging recesses are maintained by the elastic force of the elastic portions, thereby maintaining the mounted condition of the marking plate. When the marking plate is pulled away from the front surface of the plate in the mounted condition, the elastic portions are further elastically deformed to allow the disengagement.

15 Claims, 9 Drawing Sheets

MOUNTING STRUCTURE FOR MARKING PLATE

CROSS REFERENCES TO RELATED APPLICATIONS

The present invention contains subject matter related to Japanese Patent Application JP 2005-358595 filed in the Japanese Patent Office on Dec. 13, 2005, the entire contents of which being incorporated herein by reference.

BACKGROUND OF THE INVENTION

1. Field of the Invention

The present invention relates to a structure for mounting a marking plate on various kinds of equipment or devices.

2. Description of the Related Art

A marking plate bearing a marking having directionality such as information, picture, and form is mounted on various kinds of equipment or devices.

Mounting of such a marking plate is realized in related art by inserting an lock pawl projecting from the back (lower) surface of the marking plate into a hole formed through a platelike member, and engaging the tip end (lower end) of the lock pawl with the back surface of the platelike member (see Japanese Patent Laid-open No. 2002-271053).

For example, a monitoring camera is used in one mode where the monitoring camera is set with its lower portion oriented downward or in another mode where the monitoring camera is set with its lower portion oriented upward. In the case that a marking plate bearing a company name or a trade name is mounted on the case of the monitoring camera with the lower portion of the marking plate oriented downward, the marking plate should be rotated 180° in changing the orientation of the lower portion of the monitoring camera.

However, in the mounting structure in related art using the lock pawl mentioned above, the lock pawl should be disengaged from the lower surface of the platelike member every time the marking plate is rotated to change its orientation. Thus, the orientation of the marking plate may not be easily changed.

It is desirable to provide a mounting structure for a marking plate which can realize easy change in orientation of the marking plate with a simplification of arrangement and a cost reduction.

SUMMARY OF THE INVENTION

In accordance with a first aspect of the present invention, there is provided a structure for mounting a marking plate bearing a marking having directionality such as information, picture, and form on the front surface of a platelike member so that the marking plate can be rotationally adjusted every predetermined angle about a hypothetical axis passing through the thickness direction of the platelike member. The structure for mounting the marking plate is as follows. The marking plate has a stem projecting from the back surface of the marking plate, the stem extending through the thickness direction of the platelike member in the condition where the back surface of the marking plate is in contact with the front surface of the platelike member, so that the stem is rotatably supported to the platelike member. The back surface of the marking plate is formed with an engaging portion of the marking plate side for adjusting the rotational angle of the marking plate on the platelike member. The front surface of the platelike member is formed with an engaging portion of the platelike member side adapted to engage with the engaging portion of the marking plate side for determining the rotational angle of the marking plate on the front surface of the platelike member by the engagement with the engaging portion of the marking plate side. A spring member is provided on the back surface of the platelike member and supported to the tip end of the stem so that the downward movement of the spring member from the tip end of the stem in the axial direction of the stem is limited. The spring member has an elastic portion adapted to come into elastic contact with the back surface of the platelike member in the condition where the engaging portion of the marking plate side is engaged with the engaging portion of the platelike member side, thereby maintaining the engagement of the engaging portion of the marking plate side and engaging portion of the platelike member side owing to the elastic force of the elastic portion to thereby maintain the mounted condition of the marking plate. When the marking plate is pulled away from the front surface of the platelike member in the mounted condition of the marking plate, the elastic portion is elastically deformed to allow the disengagement of the engaging portion of the marking plate side from the engaging portion of the platelike member side.

In accordance with a second aspect of the present invention, there is provided a structure for mounting a marking plate bearing a marking having directionality such as information, picture, and form on the front surface of a platelike member so that the marking plate can be rotationally adjusted every predetermined angle about a hypothetical axis passing through the thickness direction of the platelike member. The structure for mounting the marking plate is as follows. The marking plate has a stem projecting from the back surface of the marking plate, the stem extending through the thickness direction of the platelike member in the condition where the back surface of the marking plate is in contact with the front surface of the platelike member, so that the stem is rotatably supported to the platelike member. The back surface of the platelike member is formed with an engaging recess of the platelike member side for determining the rotational angle of the marking plate on the front surface of the platelike member. A spring member is provided on the back surface of the platelike member and supported to the tip end of the stem so that the downward movement of the spring member from the tip end of the stem in the axial direction of the stem is limited and integral rotation of the spring member and the stem is allowed. The spring member is formed with an elastic portion and the elastic portion is formed with an engaging projection of the spring member side adapted to engage with the engaging recess of the platelike member side. The elastic portion is elastically deformed in the condition where the engaging recess of the platelike member side is engaged with the engaging projection of the spring member side, thereby maintaining the engagement of the engaging recess of the platelike member side and the engaging projection of the spring member side owing to the elastic force of the elastic portion to thereby maintain the mounted condition of the marking plate. When the marking plate is rotated about the axis of the stem in the mounted condition of the marking plate, the elastic portion is elastically deformed to allow the disengagement of the engaging recess of the spring member side from the engaging recess of the platelike member side.

According to the mounting structure in the first aspect of the present invention, the orientation of the marking plate can be changed simply and quickly by first pulling the marking plate away from the platelike member so as to disengage the engaging portion of the marking plate side from the engaging portion of the platelike member side, next rotating the marking plate by a predetermined angle in the pulled condition of the marking plate, and finally releasing the marking plate to reengage the engaging portion of the marking plate side with the engaging portion of the platelike member side. Further, the parts to be used are the marking plate and the spring member, and it is therefore advantageous in realizing the simplification of arrangement and the cost reduction.

According to the mounting structure in the second aspect of the present invention, the orientation of the marking plate can be changed simply and quickly by rotating the marking plate in the mounted condition. Further, the parts to be used are the marking plate and the spring member, and it is therefore advantageous in realizing the simplification of arrangement and the cost reduction.

Other features of the invention will be more fully understood from the following detailed description and appended claims when taken with the accompanying drawings.

DETAILED DESCRIPTION OF THE PREFERRED EMBODIMENTS

A preferred embodiment of the present invention applied to a monitoring camera will now be described with reference to the drawings.

Figure 1:
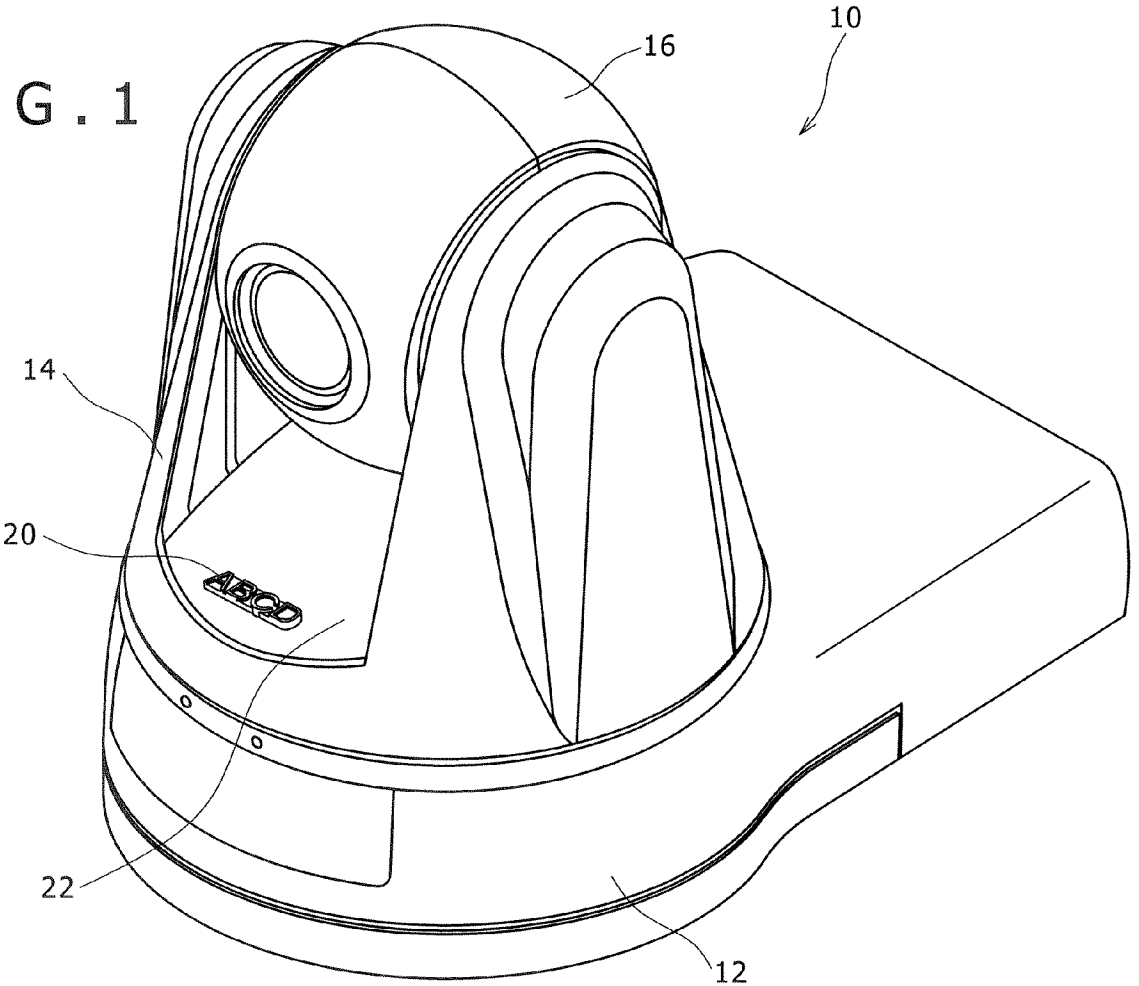
FIG. 1 is a perspective view of a monitoring camera using a mounting structure for a marking plate according to a preferred embodiment of the present invention.

Referring to FIG. 1, there is shown a monitoring camera 10 in perspective. The monitoring camera 10 has a lower portion 12, an upper portion 14 rotatably mounted on the lower portion 12 so as to be rotatable about a vertical axis, and a camera portion 16 rotatably supported to a pair of forked portions of the upper portion 14 so as to be rotatable about a horizontal axis. The monitoring camera 10 is used in such a manner that the lower portion 12 is oriented downward as shown in FIG. 1 and mounted on a building body or the like or that the lower portion 12 is oriented upward and mounted on a ceiling or the like.

Reference numeral 20 denotes a marking plate bearing a marking such as a string of letters representing a company name or a trade name on its surface. The marking plate 20 is provided on a plate 22 which connects the base portions of the pair of forked portions of the upper portion 14.

In the use mode of the monitoring camera 10 such that the lower portion 12 is oriented downward, the marking plate 20 is oriented as shown in FIG. 1. Conversely, in the use mode of the monitoring camera 10 such that the lower portion 12 is oriented upward, the orientation of the marking plate 20 mounted on the plate 22 is to be changed 1800 for the purpose of easy reading of the letters formed on the surface of the marking plate 20.

In mounting the marking plate 20 in each use mode, the mounting structure according to the present invention is adopted.

Figure 2:
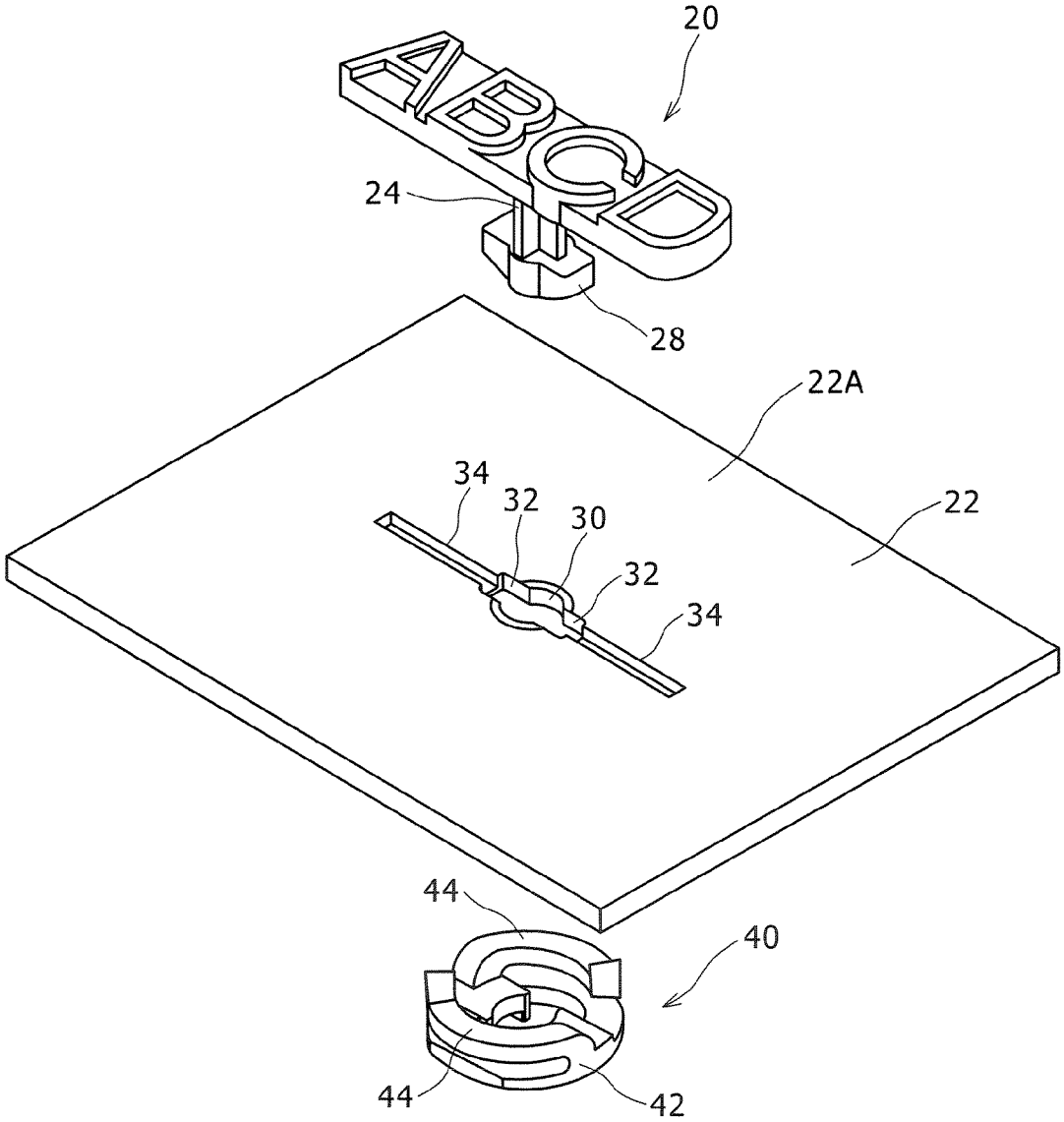
FIG. 2 is an exploded perspective view of the mounting structure for the marking plate as viewed from the upper side thereof.
Figure 3:
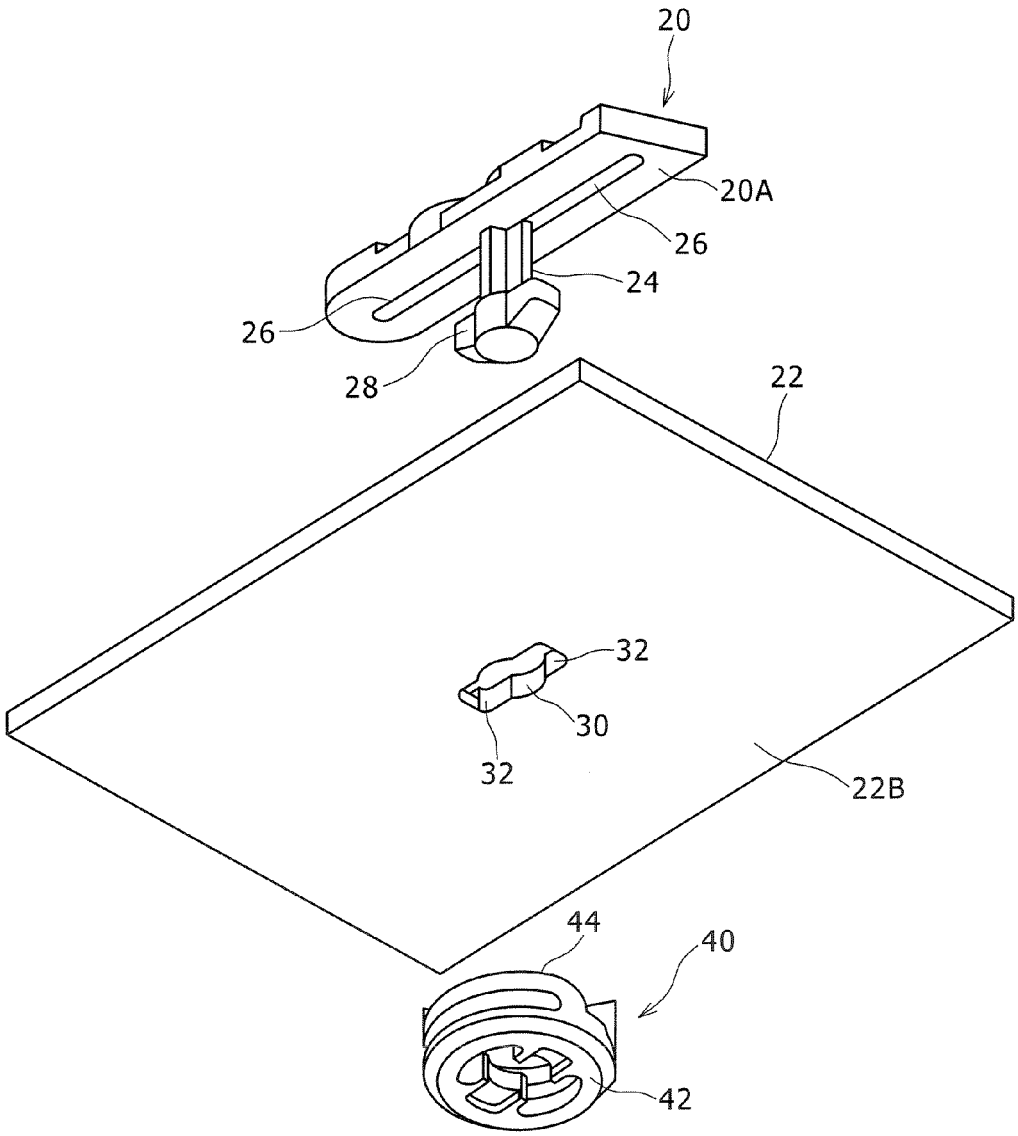
FIG. 3 is an exploded perspective view of the mounting structure for the marking plate as viewed from the lower side thereof.
Figure 4:
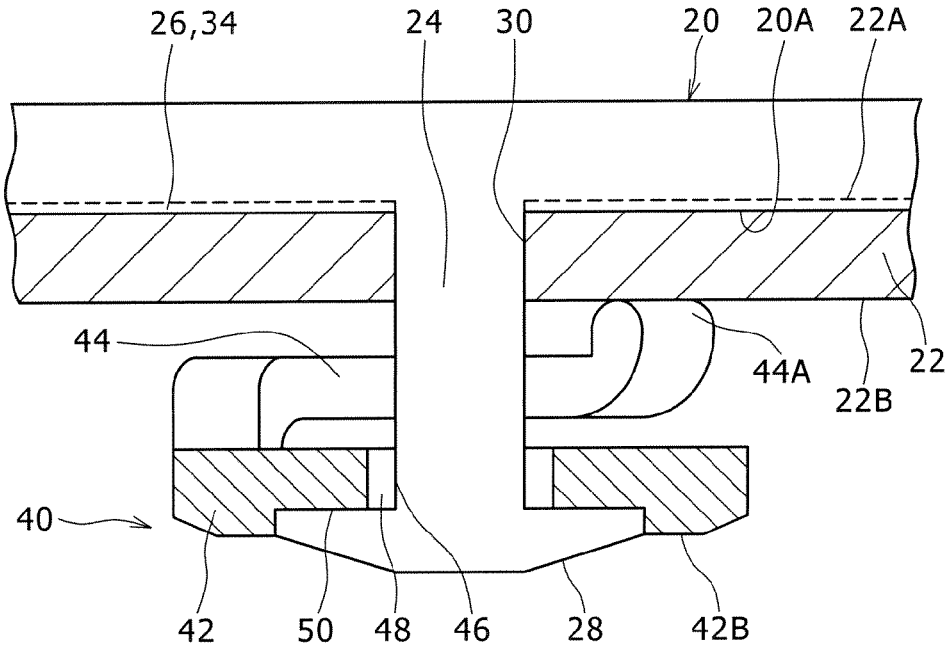
FIG. 4 is a vertical sectional view of the mounting structure in the mounted condition of the marking plate.

FIG. 2 is an exploded perspective view of the mounting structure for the marking plate 20 as viewed from the upper side thereof, FIG. 3 is an exploded perspective view of the mounting structure for the marking plate 20 as viewed from the lower side thereof, and FIG. 4 is a vertical sectional view of the mounting structure in the mounted condition of the marking plate 20.

The mounting structure for the marking plate 20 is a structure for rotatably mounting the marking plate 20 on the front surface (upper surface) 22A of the plate 22 so that the marking plate 20 can be rotationally adjusted every predetermined angle (every 180° in this preferred embodiment) about a hypothetical axis passing through the thickness direction of the plate 22 (vertically extending center axis of the marking plate 20).

While the marking plate 20 and the plate 22 are formed of synthetic resin in this preferred embodiment, the marking plate 20 and the plate 22 may be formed of metal.

The marking plate 20 is formed with a stem 24 projecting from the back surface (lower surface) 20A of the marking plate 20. In the mounted condition where the back surface 20A of the marking plate 20 is in contact with the front surface 22A of the plate 22, the stem 24 extends through the thickness direction of the plate 22. The back surface 20A of the marking plate 20 is further formed with a pair of engaging portions 26 of the marking plate side for adjusting the rotational angle of the marking plate 20 on the plate 22.

The stem 24 has a cross-shaped section in this preferred embodiment.

The engaging portions 26 of the marking plate side are formed as a pair of ridge projecting from the back surface 20A of the marking plate 20 and extending oppositely from the root of the stem 24 in the longitudinal direction of the marking plate 20.

The stem 24 is formed at its tip end with a pair of lock pawls 28 projecting oppositely in the radial direction of the stem 24. In this preferred embodiment, the direction of projection of the lock pawls 28 is the same as the direction of extension of the engaging portions 26 of the marking plate side.

The plate 22 is formed with an insert hole 30 for allowing the insertion of the stem 24 and rotatably supporting the stem 24 and a pair of notches 32 communicating with the insert hole 30 for allowing the pass of the lock pawls 28 to the back surface 22B (the under side of the lower surface) of the plate 22.

The front surface 22A of the plate 22 is formed with a pair of engaging portions 34 of the plate side adapted to engage with the pair of engaging portions 26 of the marking plate side for determining the rotational angle of the marking plate 20 on the front surface 22A of the plate 22 by the engagement with the engaging portions 26. In this preferred embodiment, the engaging portions 34 of the plate side are formed as a pair of grooves formed on the front surface 22A of the plate 22 and extending oppositely from the notches 32.

Alternatively, the engaging portions 26 of the marking plate side may be formed as a pair of grooves, and the engaging portions 34 of the plate side may be correspondingly formed as a pair of ridges.

A spring member 40 is provided on the back surface 22B of the plate 22.

Figure 5:
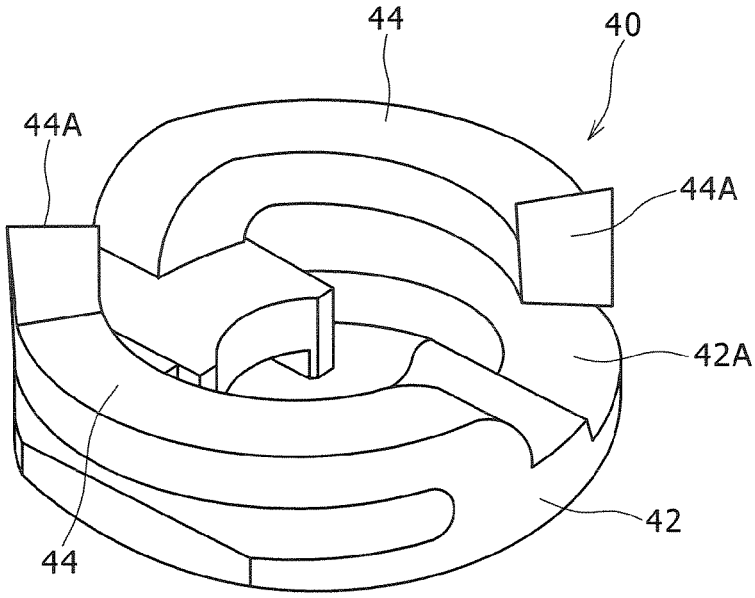
FIG. 5 is a perspective view of a spring member as viewed from the upper side thereof.
Figure 6:
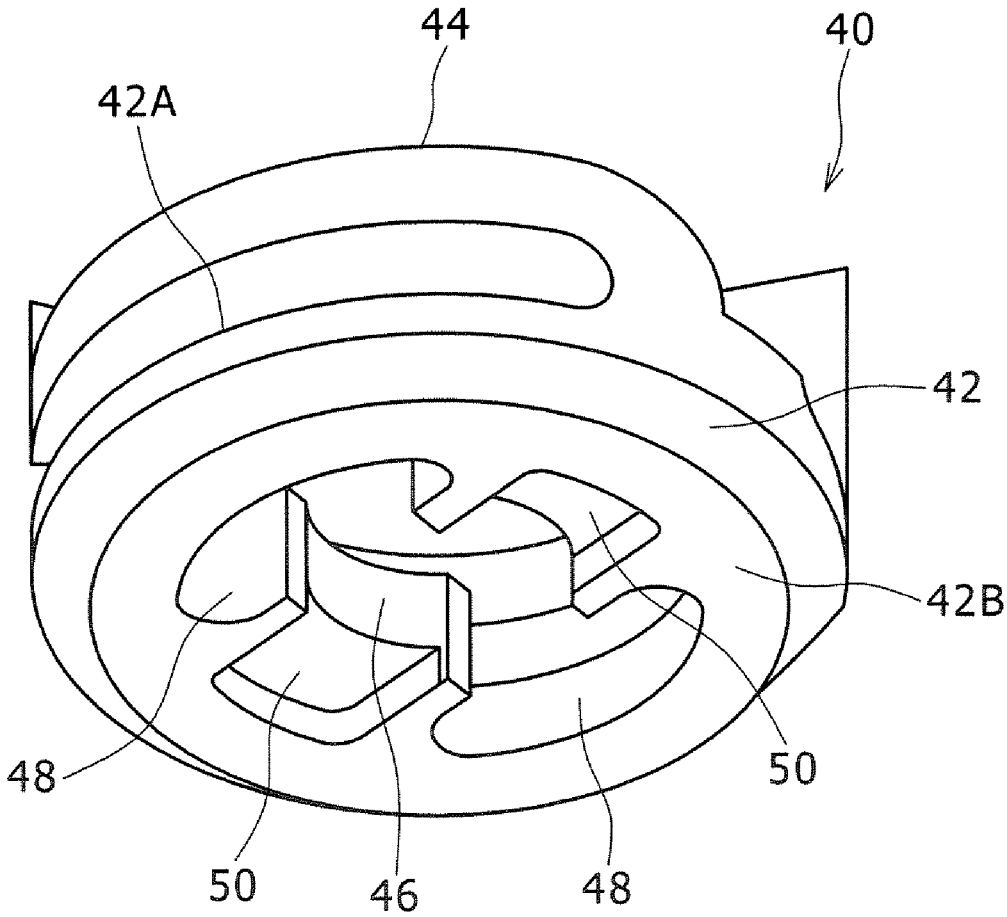
FIG. 6 is a perspective view of the spring member as viewed from the lower side thereof.
Figure 7A:
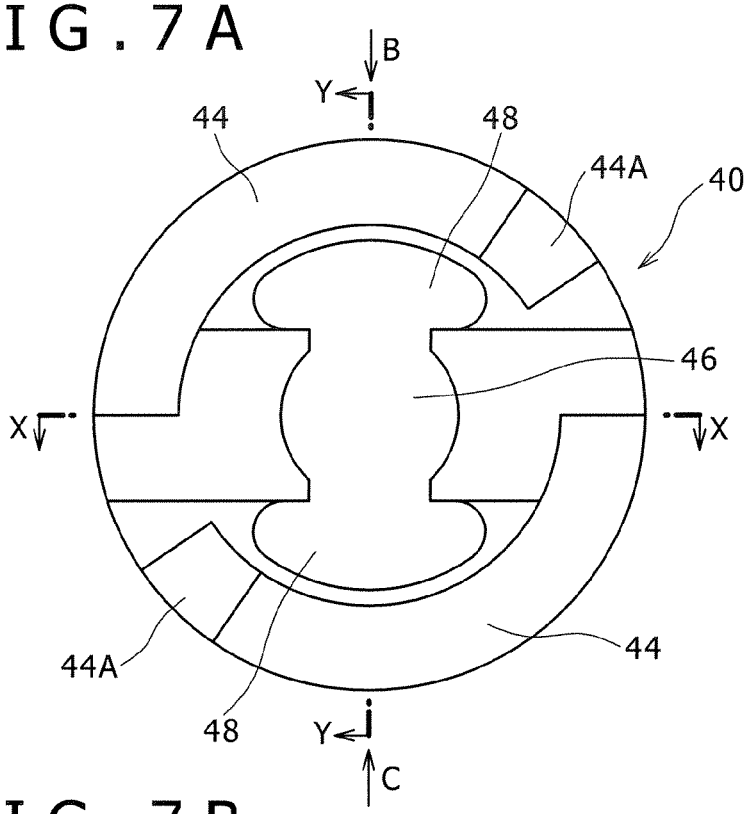
FIG. 7A is a top plan view of the spring member.
Figure 7B:
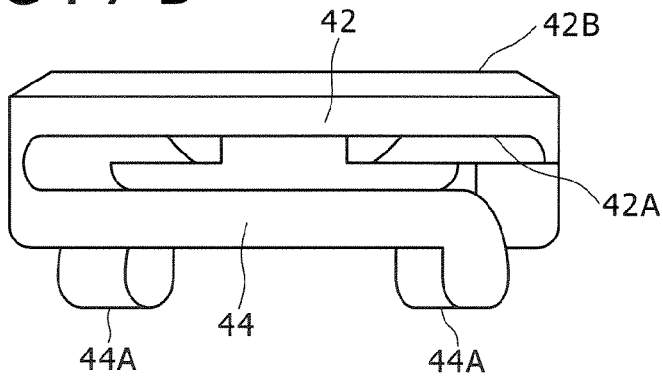
FIG. 7B is a view taken in the direction shown by an arrow B in FIG. 7A.
Figure 7C:
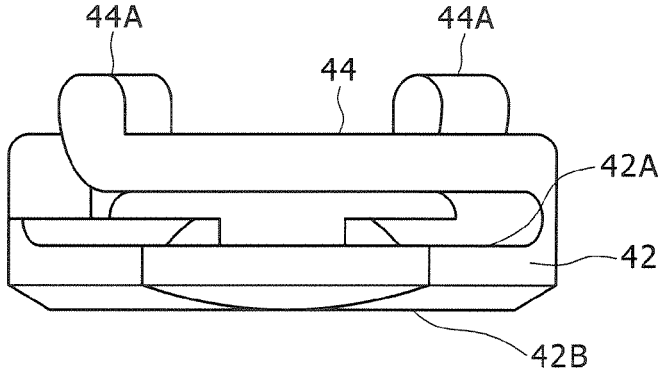
FIG. 7C is a view taken in the direction shown by an arrow C in FIG. 7A.
Figure 8:
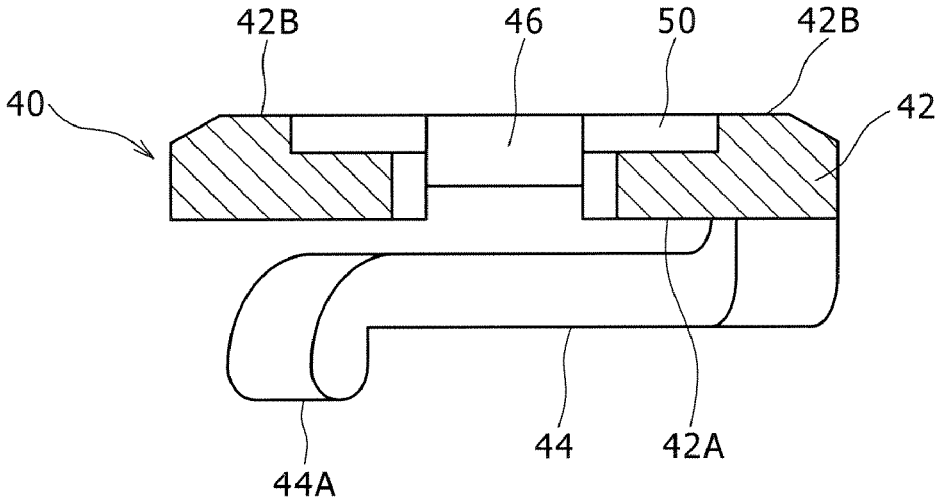
FIG. 8 is a cross section taken along the line X-X in FIG. 7A.
Figure 9:
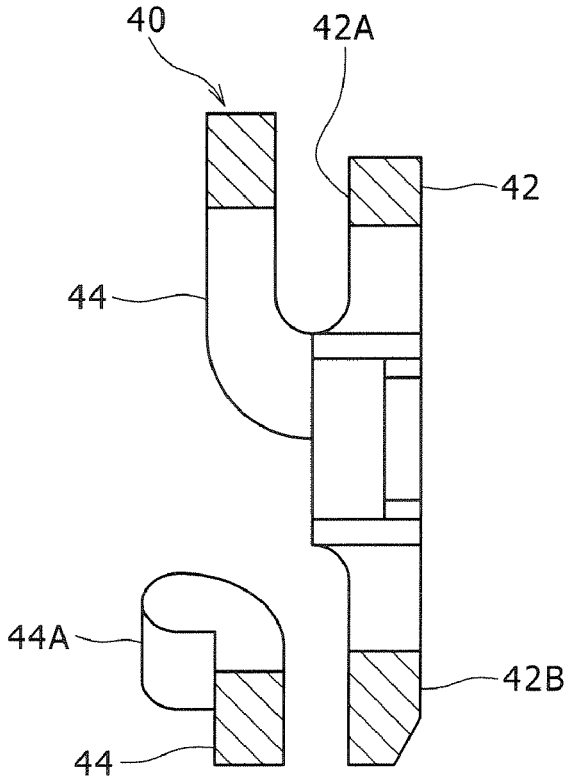
FIG. 9 is a cross section taken along the line Y-Y in FIG. 7A.
Figure 10:
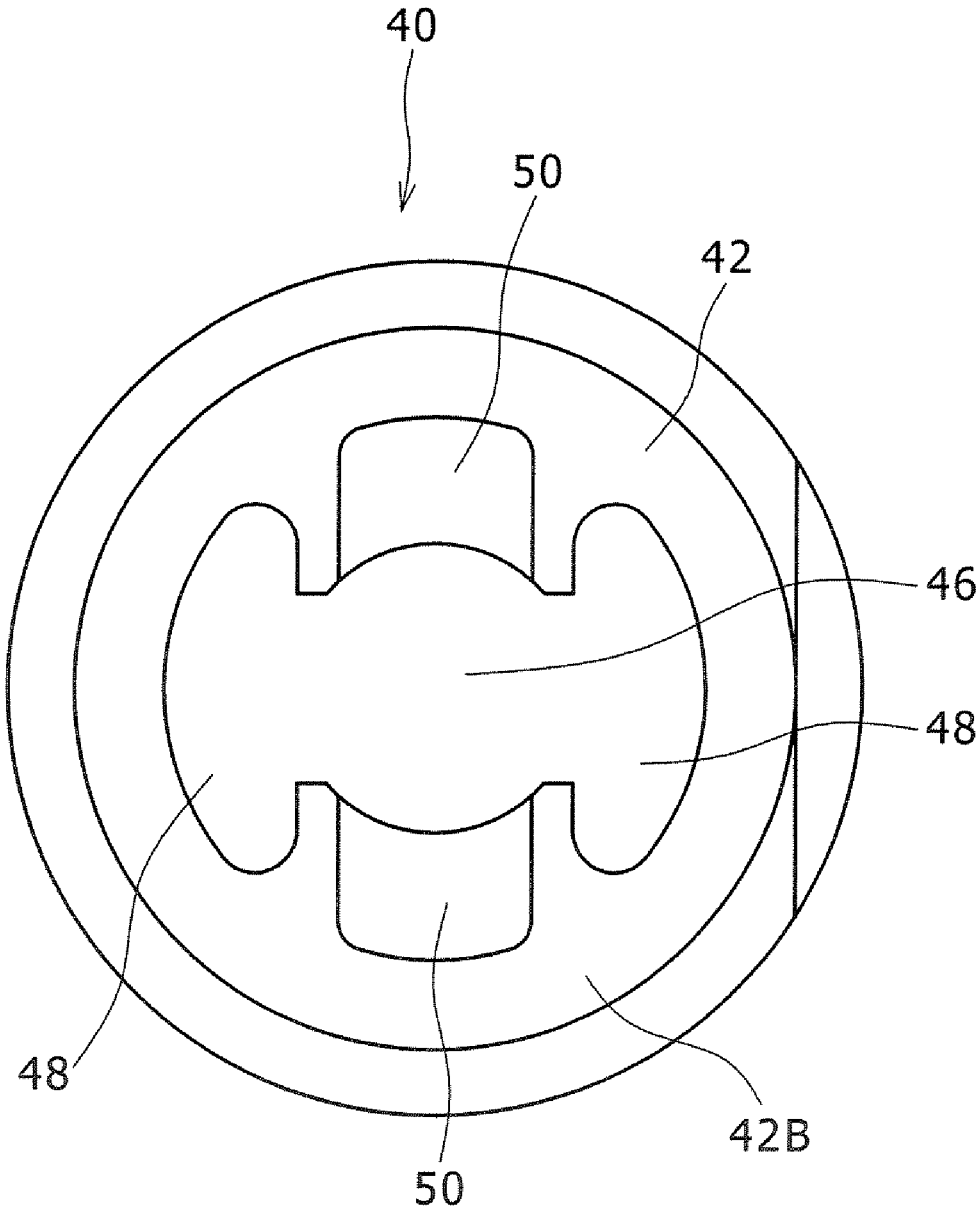
FIG. 10 is a bottom plan view of the spring member.

FIG. 5 is a perspective view of the spring member 40 as viewed from the upper side thereof, FIG. 6 is a perspective view of the spring member 40 as viewed from the lower side thereof, FIG. 7A is a top plan view of the spring member 40, FIG. 7B is a view taken in the direction shown by an arrow B in FIG. 7A, FIG. 7C is a view taken in the direction shown by an arrow C in FIG. 7A, FIG. 8 is a cross section taken along the line X-X in FIG. 7A, FIG. 9 is a cross section taken along the line Y-Y in FIG. 7A, and FIG. 10 is a bottom plan view of the spring member 40.

The spring member 40 includes a body portion 42 and a pair of elastic portions 44. The body portion 42 has an front surface (upper surface) 42A faced to the back surface 22B of the plate 22. The elastic portions 44 are formed on the front surface 42A of the body portion 42.

The spring member 40 is an integral member formed of synthetic resin or rubber, so that the body portion 42 and the elastic portions 44 are integral with each other.

Polycarbonate may be adopted as the synthetic resin for the material of the spring member 40, and hard rubber may be adopted as the rubber for the material of the spring member 40.

The body portion 42 is a disk-shaped portion in this preferred embodiment.

As shown in FIG. 7A, the body portion 42 is formed with a central insert hole 46 for allowing the insertion of the stem 24 and a pair of notches 48 communicating with the insert hole 46 for allowing the pass of the lock pawls 28 to the back surface (lower surface) 42B of the body portion 42 opposite to the front surface 42A.

As shown in FIGS. 4, 6, 8, and 10, the back surface 42B of the body portion 42 is formed with a pair of engaging recesses 50 adapted to engage with the lock pawls 28 for connecting the body portion 42 to the marking plate 20 so as to allow integral rotation thereof.

In this preferred embodiment, the direction of arrangement of the notches 48 is perpendicular to the direction of arrangement of the engaging recesses 50 in a plane perpendicular to the center of the insert hole 46.

As shown in FIG. 7A, the pair of elastic portions 44 are formed along the outer circumferential portion of the front surface 42A of the body portion 42 radially outside of the insert hole 46 and the notches 48 so as to be spaced apart from each other in the circumferential direction of the body portion 42.

Each elastic portion 44 is spaced apart from the front surface 42A of the body portion 42 and extends arcuately along the outer circumference of the front surface 42A.

Each elastic portion 44 is formed at its tip end of the extending direction with a projection 44A projecting toward the back surface 22B of the plate 22 and adapted to come into elastic contact with the back surface 22B.

As shown in FIG. 4, the engaging portions 26 of the marking plate side are engaged with the engaging portions 34 of the plate side, and the back surface 20A of the marking plate 20 abuts against the front surface 22A of the plate 22. The stem 24 is inserted through the insert hole 30 of the plate 22 and the insert hole 46 of the spring member 40, and the lock pawls 28 are passed through the notches 32 of the plate 22 and the notches 48 of the spring member 40 to the position under the back surface 42B of the body portion 42 of the spring member 40. In this condition, the spring member 40 is rotated to engage the lock pawls 28 with the engaging recesses 50, thus obtaining the mounted condition of the marking plate 20.

In the above mounted condition where the engaging portions 26 of the marking plate side are engaged with the engaging portions 34 of the plate side, and the lock pawls 28 are engaged with the engaging recesses 50, the elastic portions 44 of the spring member 40 are elastically deformed so that the projections 44A of the elastic portions 44 are kept in elastic contact with the back surface 22B of the plate 22. Accordingly, the engagement of the engaging portions 26 of the marking plate side and the engaging portions 34 of the plate side and the engagement of the lock pawls 28 and the engaging recesses 50 are maintained by the elastic force of the elastic portions 44 of the spring member 40, so that the mounted condition of the marking plate 20 is maintained.

The elastic force of the elastic portions 44 of the spring member 40 is set so that when the marking plate 20 in its mounted condition is pulled away from the front surface 22A of the plate 22, the elastic portions 44 are further elastically deformed to allow the disengagement of the engaging portions 26 of the marking plate side from the engaging portions 34 of the plate side.

When the marking plate 20 is rotated 180° in the above pulled condition that the engaging portions 26 of the marking plate side are disengaged from the engaging portions 34 of the plate side, the engaging portions 26 come again into engagement with the engaging portions 34 of the plate side owing to the elastic force of the elastic portions 44 to thereby obtain another mounted condition of the marking plate 20 where the orientation of the marking plate 20 has been changed 1800.

The marking plate 20 and the spring member 40 are mounted to the plate 22 in the following manner. As shown in FIG. 4, the engaging portions 26 of the marking plate side are engaged with the engaging portions 34 of the plate side, and the back surface 20A of the marking plate 20 is brought into abutment against the front surface 22A of the plate 22. In this condition, the spring member 40 is pressed against the back surface 22B of the plate 22 to elastically deform the elastic portions 44. Then the lock pawls 28 which are inserted through the plate 22 and the spring member 40 apart from the engaging recesses 50. In this condition, the spring member 40 is rotated until the direction of arrangement of the engaging recesses 50 come into coincidence with the direction of arrangement of the lock pawls 28. Thereafter, when the force of pressing the spring member 40 against the plate 22 is removed, the engaging recesses 50 come into engagement with the lock pawls 28 owing to the elastic force of the elastic portions 44.

In removing the marking plate 20 and the spring member 40 from the plate 22, the following operation is performed. While the marking plate 20 is abutted against the front surface 22A of the plate 22, the spring member 40 is pressed against the back surface 22B of the plate 22 in the mounted condition shown in FIG. 4, thus elastically deforming the elastic portions 44. Accordingly, the engaging recesses 50 of the spring member 40 are disengaged from the lock pawls 28 of the marking plate 20. In this condition, the spring member 40 is rotated until the direction of arrangement of the notches 48 come into coincidence with the direction of arrangement of the lock pawls 28. Thereafter, when the force of pressing the spring member 40 against the plate 22 is removed, the lock pawls 28 are passed through the notches 48 of the spring member 40, thereby removing the spring member 40. Thereafter, the lock pawls 28 are passed through the notches 32 of the plate 22 to thereby remove the marking plate 20.

Thus, the two parts, i.e., the marking plate 20 and the spring member 40 are to be handled in the mounting and removing operations, so that these operations can be performed simply and quickly.

Further, according to this preferred embodiment, the orientation of the marking plate 20 can be changed simply and quickly by the operation such that the marking plate 20 is pulled away from the plate 22 so as to disengage the engaging portions 26 of the marking plate side from the engaging portions 34 of the plate side and that the marking plate 20 is rotated 180° in the above pulled condition and the operator's hand is thereafter removed from the marking plate 20.

Further, the parts to be used are the marking plate 20 and the spring member 40, and it is therefore advantageous in realizing the simplification of arrangement and the cost reduction.

The body portion 42 of the spring member 40 is a disk-shaped portion, and each elastic portion 44 extends arcuately along the outer circumference of the front surface 42A of the body portion 42. Accordingly, the configuration of the spring member 40 can save the space both in the axial direction and in the direction perpendicular to the axial direction, and it is therefore advantageous in making the spring member 40 compact.

A modification of the above preferred embodiment will now be described with reference to FIG. 11.

Figure 11:
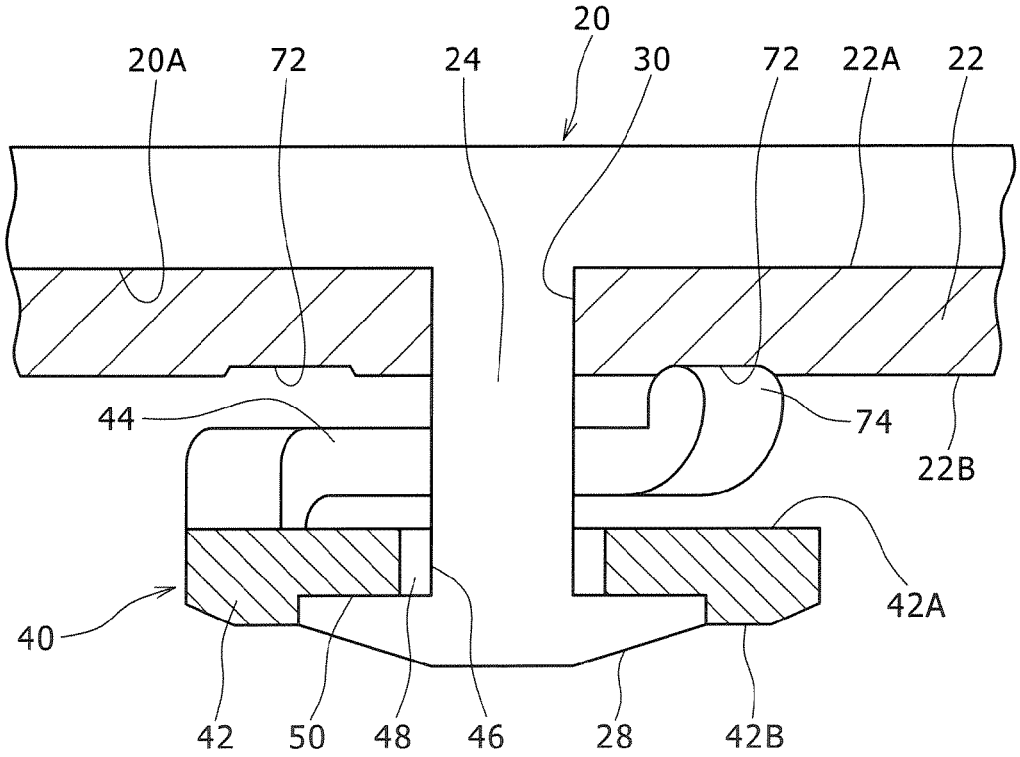
FIG. 11 is a sectional view showing a mounted condition of marking plate according to a modification of the preferred embodiment.

FIG. 11 is a sectional view showing a mounted condition of a marking plate 20 in the modification, wherein like portions and members as in the above preferred embodiment are denoted by the same reference numerals and the description thereof will be omitted herein. The following description will be applied to the difference from the above preferred embodiment.

In the above preferred embodiment, the engaging portions 26 and the engaging portions 34 of the plate side for determining the rotational angle of the marking plate 20 are formed on the back surface 20A of the marking plate 20 and the front surface 22A of the plate 22, respectively. In contrast thereto, determination of the rotational angle of the marking plate 20 is formed at the tip end of each elastic portion 44 of the spring member 40 and on the back surface 22B of the plate 22 in this modification.

More specifically, this determination of the rotational angle of the marking plate 20 is composed of a pair of engaging recesses 72 of the plate side formed on the back surface 22B of the plate 22 and a pair of engaging projections 74 of the spring member side formed at the tip ends of the pair of elastic portions 44 of the spring member 40. The engaging recesses 72 of the plate side are spaced 1800 apart from each other around the insert hole 30 of the plate 22, and the engaging projections 74 of the spring member side are formed by the upward projections at the tip ends of the elastic portions 44 so as to respectively engage with the engaging recesses 72 of the plate side.

The elastic portions 44 are elastically deformed in the condition where the engaging recesses 72 of the plate side are engaged with the engaging projections 74 of the spring member side and the lock pawls 28 are engaged with the engaging recesses 50, so that the engagement of the engaging recesses 72 of the plate side and the engaging projections 74 of the spring member side and the engagement of the lock pawls 28 and the engaging recesses 50 are maintained by the elastic force of the elastic portions 44, thus maintaining the mounted condition of the marking plate 20.

When the marking plate 20 is rotated about the axis of the stem 24 by applying a predetermined force in the above mounted condition of the marking plate 20, the elastic portions 44 are elastically deformed and the spring member 40 is also rotated with the marking plate 20, so that the engaging projections 74 of the spring member side are disengaged from the engaging recesses 72 of the plate side.

According to this modification, it is not necessary to pull up the marking plate 20 in the mounted condition thereof in rotating the marking plate 20 as in the above preferred embodiment, but the orientation of the marking plate 20 can be easily changed by rotating the marking plate 20 in the mounted condition thereof. More specifically, when the marking plate 20 is rotated 180° from the mounted condition, the engaging projections 74 of the spring member side come again into engagement with the engaging recesses 72 of the plate side with a tactile feel. Accordingly, the operator rotating the marking plate 20 can easily recognize the 180° rotation of the marking plate 20.

As similar to the above preferred embodiment, the orientation of the marking plate 20 can be changed simply and quickly. Further, it is advantageous in realizing the simplification of arrangement and the cost reduction, and it is also advantageous in making the spring member 40 compact.

While the marking plate 20 is mounted on the monitoring camera 10 in the preferred embodiment and the modification described above, the equipment on which the marking plate 20 is mounted is not limited to the monitoring camera 10, but various kinds of equipment or devices may be adopted.

The marking borne by the marking plate 20 is not limited to a string of letters as in the above preferred embodiment, but may include any marking having directionality such as information, picture, and form.

The adjustable rotational angle of the marking plate 20 is not limited to 180°, but any adjustable rotational angle such as 90° or 60° may be set by increasing the number of engaging portions 34 of the plate side or engaging recesses 72 of the plate side.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A structure for mounting a marking plate bearing a marking having directionality such as information, picture, and form on the front surface of a platelike member so that said marking plate can be rotationally adjusted every predetermined angle about a hypothetical axis passing through the thickness direction of said platelike member, wherein:

said marking plate has a stem projecting from the back surface of said marking plate, said stem extending through the thickness direction of said platelike member in the condition where the back surface of said marking plate is in contact with the front surface of said platelike member, so that said stem is rotatably supported to said platelike member;

the back surface of said marking plate is formed with an engaging portion of said marking plate side for adjusting the rotational angle of said marking plate on said platelike member;

the front surface of said platelike member is formed with an engaging portion of said platelike member side adapted to engage with said engaging portion of said marking plate side for determining the rotational angle of said marking plate on the front surface of said platelike member by the engagement with said engaging portion of said marking plate side;

a spring member is provided on the back surface of said platelike member and supported to the tip end of said stem so that the downward movement of said spring member from the tip end of said stem in the axial direction of said stem is limited;

said spring member has an elastic portion adapted to come into elastic contact with the back surface of said platelike member in the condition where said engaging portion of said marking plate side is engaged with said engaging portion of said platelike member side, thereby maintaining the engagement of said engaging portion of said marking plate side and said engaging portion of said platelike member side owing to the elastic force of said elastic portion to thereby maintain the mounted condition of said marking plate; and when said marking plate is pulled away from the front surface of said platelike member in the mounted condition of said marking plate, said elastic portion is elastically deformed to allow the disengagement of said engaging portion of said marking plate side from said engaging portion of said platelike member side.

2. The structure for mounting a marking plate according to claim 1, wherein:

said spring member has a disk-shaped body portion;

said elastic portion is formed on the front surface of said body portion faced to said platelike member; and said elastic portion is formed at an outer circumferential portion of the front surface of said body portion and is spaced apart from the front surface of said body portion so as to extend arcuately along the outer circumference of the front surface of said body portion.

3. The structure for mounting a marking plate according to claim 2, wherein said elastic portion has a plurality of elastic portions spaced apart from each other in the circumferential direction of said body portion.

4. The structure for mounting a marking plate according to claim 2, wherein said elastic portion is formed at its tip end of the extending direction with a projection projecting toward the back surface of said platelike member and adapted to come into elastic contact with the back surface of said platelike member.

5. The structure for mounting a marking plate according to claim 1, wherein said spring member is connected to the tip end of said stem so as to rotate with said stem.

6. The structure for mounting a marking plate according to claim 1, wherein:

said stem is formed at its tip end with an lock pawl projecting in the radial direction of said stem;

said platelike member is formed with a insert hole for allowing the insertion of said stem and rotatably supporting said stem and a notch communicating with said insert hole for allowing the pass of said lock pawl to the back surface of said platelike member;

said spring member has a body portion having an front surface faced to said platelike member, said elastic portion being formed on the front surface of said body portion;

said body portion is formed with a insert hole for allowing the insertion of said stem and a notch communicating with said insert hole for allowing the pass of said lock pawl to the back surface of said body portion opposite to the front surface thereof;

the back surface of said body portion is formed with an engaging recess adapted to engage with said lock pawl for connecting said body portion to said marking plate so as to allow integral rotation thereof;

said spring member is connected to the tip end of said stem so as to rotate together in the condition where said stem is inserted through said insert holes of said platelike member and said body portion and said lock pawl is passed through said notches of said platelike member and said body portion and engaged with said engaging recess; and said elastic portion is elastically deformed to come into elastic contact with the back surface of said platelike member in the condition where said lock pawl is engaged with said engaging recess, and the engagement of said lock pawl and said engaging recess is maintained by the elastic force of said elastic portion.

7. The structure for mounting a marking plate according to claim 6, wherein said notch of said body portion and said engaging recess formed on the back surface of said body portion extend in perpendicular directions in a plane perpendicular to the center of said insert hole.

8. The structure for mounting a marking plate according to claim 1, wherein one of said engaging portion of said marking plate side and said engaging portion of said platelike member side is formed as a ridge, and the other is formed as a groove for engaging said ridge.

9. The structure for mounting a marking plate according to claim 1, wherein said spring member has a body portion and said elastic portion integral with said body portion, and said spring member is formed of synthetic resin or rubber.

10. A structure for mounting a marking plate bearing a marking having directionality such as information, picture, and form on the front surface of a platelike member so that said marking plate can be rotationally adjusted every predetermined angle about a hypothetical axis passing through the thickness direction of said platelike member, wherein:

said marking plate has a stem projecting from the back surface of said marking plate, said stem extending through the thickness direction of said platelike member in the condition where the back surface of said marking plate is in contact with the front surface of said platelike member, so that said stem is rotatably supported to said platelike member;

the back surface of said platelike member is formed with an engaging recess of said platelike member side for determining the rotational angle of said marking plate on the front surface of said platelike member;

a spring member is provided on the back surface of said platelike member and supported to the tip end of said stem so that the downward movement of said spring member from the tip end of said stem in the axial direction of said stem is limited and integral rotation of said spring member and said stem is allowed;

said spring member is formed with an elastic portion;

said elastic portion is formed with an engaging projection of said spring member side adapted to engage with said engaging recess of said platelike member side;

said elastic portion is elastically deformed in the condition where said engaging recess of said platelike member side is engaged with said engaging projection of said spring member side, thereby maintaining the engagement of said engaging recess of said platelike member side and said engaging projection of said spring member side owing to the elastic force of said elastic portion to thereby maintain the mounted condition of said marking plate; and when said marking plate is rotated about the axis of said stem in the mounted condition of said marking plate, said elastic portion is elastically deformed to allow the disengagement of said engaging projection of said spring member side from said engaging recess of said platelike member side.

11. The structure for mounting a marking plate according to claim 10, wherein:

said spring member has a disk-shaped body portion;

said elastic portion is formed on the front surface of said body portion faced to said platelike member;

said elastic portion is formed at an outer circumferential portion of the front surface of said body portion and is spaced apart from the front surface of said body portion so as to extend arcuately along the outer circumference of the front surface of said body portion; and said engaging projection of said spring member side is formed at the tip end of the extending direction of said elastic portion.

12. The structure for mounting a marking plate according to claim 11, wherein said elastic portion has a plurality of elastic portions spaced apart from each other in the circumferential direction of the front surface of said body portion.

13. The structure for mounting a marking plate according to claim 10, wherein:

said stem is formed at its tip end with an lock pawl projecting in the radial direction of said stem;

said platelike member is formed with a insert hole for allowing the insertion of said stem and rotatably supporting said stem and a notch communicating with said insert hole for allowing the pass of said lock pawl to the back surface of said platelike member;

said spring member has a body portion having an front surface faced to said platelike member, said elastic portion being formed on the front surface of said body portion;

said body portion is formed with a insert hole for allowing the insertion of said stem and a notch communicating with said insert hole for allowing the pass of said lock pawl to the back surface of said body portion opposite to the front surface thereof;

the back surface of said body portion is formed with an engaging recess adapted to engage with said lock pawl for connecting said body portion to said marking plate so as to allow integral rotation thereof;

said spring member is connected to the tip end of said stem so as to rotate together in the condition where said stem is inserted through said insert holes of said platelike member and said body portion and said lock pawl is passed through said notches of said platelike member and said body portion and engaged with said engaging recess; and said elastic portion is elastically deformed in the condition where said lock pawl is engaged with said engaging recess, and the engagement of said lock pawl and said engaging recess is maintained by the elastic force of said elastic portion.

14. The structure for mounting a marking plate according to claim 13, wherein said notch of said body portion and said engaging recess formed on the back surface of said body portion extend in perpendicular directions in a plane perpendicular to the center of said insert hole.

15. The structure for mounting a marking plate according to claim 10, wherein said spring member has a body portion and said elastic portion integral with said body portion, and said spring member is formed of synthetic resin or rubber.

* * * * *